US012447582B2

(12) United States Patent
Gadinski et al.

(10) Patent No.: US 12,447,582 B2
(45) Date of Patent: Oct. 21, 2025

(54) CHEMICAL MECHANICAL POLISHING PAD WITH FLUORINATED POLYMER AND MULTIMODAL GROOVE PATTERN

(71) Applicant: Rohm and Haas Electronic Materials CMP Holdings, Inc., Newark, DE (US)

(72) Inventors: Matthew R. Gadinski, Newark, DE (US); Joseph So, Wilmington, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 366 days.

(21) Appl. No.: 18/168,621

(22) Filed: Feb. 14, 2023

(65) Prior Publication Data

US 2024/0207998 A1 Jun. 27, 2024

Related U.S. Application Data

(63) Continuation-in-part of application No. 18/145,584, filed on Dec. 22, 2022, now abandoned.

(51) Int. Cl.
*B24B 37/24* (2012.01)
*B24B 37/22* (2012.01)
*B24B 37/26* (2012.01)

(52) U.S. Cl.
CPC ..... *B24B 37/24* (2013.01); *B24B 37/22* (2013.01); *B24B 37/26* (2013.01)

(58) Field of Classification Search
CPC ..... B24B 37/26; B24B 37/24; B24B 37/20; B24B 57/02; B24B 1/00; B24B 37/10; B24B 37/30; B24B 19/028; B24B 7/228; H01L 21/304; H01L 21/30625; H01L 21/67092
See application file for complete search history.

(56) References Cited

U.S. PATENT DOCUMENTS

| | | | |
|---|---|---|---|
| 6,121,143 | A | 9/2000 | Messner et al. |
| 6,749,485 | B1 | 6/2004 | James et al. |
| 8,257,544 | B2 | 9/2012 | Kulp et al. |
| 9,539,694 | B1 | 1/2017 | Kozhukh et al. |
| 10,252,396 | B2 | 4/2019 | Ehuu et al. |
| 11,331,767 | B2 | 5/2022 | Bresson |
| 11,548,114 | B1 | 1/2023 | Gadinski et al. |
| 2023/0078023 | A1 | 3/2023 | Gadinski et al. |
| 2023/0082181 | A1 | 3/2023 | Gadinski et al. |

*Primary Examiner* — Amber R Orlando
*Assistant Examiner* — Ryan Patrick Loughran
(74) *Attorney, Agent, or Firm* — Blake T. Biederman

(57) ABSTRACT

A polishing pad suitable for chemical mechanical polishing comprising: a polishing layer having a top surface having a groove pattern, the groove pattern comprises a plurality of first grooves having a first groove cross-section, the plurality of first grooves defining a plurality of regions between adjacent first grooves; and, in a portion of the plurality of region between adjacent first grooves, a plurality of second grooves having a second groove cross-section, wherein the second groove cross-section is less than 50 percent of the first groove cross-section, wherein the polishing layer is further characterized by having a specific gravity of at least 1.05 grams per cubic centimeter.

7 Claims, 7 Drawing Sheets

100 μm
MD ED

CHEMICAL MECHANICAL POLISHING PAD WITH FLUORINATED POLYMER AND MULTIMODAL GROOVE PATTERN

FIELD OF THE INVENTION

The field of this invention is chemical mechanical polishing and pads useful in chemical mechanical polishing.

BACKGROUND OF THE INVENTION

Chemical Mechanical Planarization (CMP) is a variation of a polishing process that is widely used to flatten, or planarize, the layers of construction of an integrated circuit or similar structure. Particularly, CMP is frequently used to produce planar uniform layers of a defined thickness in the manufacture build three-dimensional circuit structures by an additive stacking and planarizing process. CMP are to remove excess deposited material on the substrate (e.g. wafer) surface to produce an extremely flat layer of a uniform thickness, said uniformity extending across the entire substrate (e.g. wafer) area.

CMP utilizes a liquid, often called slurry, which can contain nano-sized particles. The slurry is fed onto the surface of a rotating multilayer polymer pad (sometimes referred to as polishing sheet), the pad being mounted on a rotating platen. The polishing pad includes a polishing layer and can include a sub-pad. Substrates (e.g. wafers) are mounted into a separate fixture, or carrier, which has a separate means of rotation, and pressed against the surface of the pad under a controlled load. This can lead to a high rate of relative motion between the substrate (e.g., wafer) and the polishing pad and a resulting high rate of shear or abrasion at both the substrate and the pad surface. The shear and the slurry particles trapped at the pad/substrate junction abrade the substrate (e.g., wafer) surface, leading to removal of material from the substrate surface.

One application of CMP is in shallow trench isolation (STI). Referring to FIG. 1, as one example, in shallow trench isolation, trenches 3 are formed in a substrate 1 (e.g., wafer) by first forming a hard mask 2 (such as a silicon nitride) in a pattern on the surface (Step A and then etching in step B to form the trenches 3 in areas of the substrate exposed by open regions in the hard mask 2. The trenches 3 are then filled with another material 4 such as a dielectric. To ensure complete filling of the trench an excess 5 of material 4 can be applied and then removed by chemical mechanical polishing. The polishing can proceed to form a planar surface of the hard mask material 2 and the material 4 filling the trench.

In STI, a degree of high planarity and low occurrence of defects are important to ensure device performance as a defect in a trench can render the device unsuitable for use. To reduce defects, the CMP may be performed under low downforce pressures (e.g., about 3 pounds per square inch). However, the low downforce reduces removal rate and throughput of manufacturing. While increasing porosity of the polishing layer of the CMP pad can improve removal rate, the increasing porosity can detrimentally affect planarity. Furthermore even with porosity, the removal rates at low downforce remain low.

Thus, a need remains for a chemical mechanical polishing pad that can provide higher removal rates, preferably with low occurrence of defects and good planarization, at low downforce pressures.

SUMMARY OF THE INVENTION

Disclosed herein is a polishing pad suitable for chemical mechanical polishing comprising: a polishing layer including a polyurea having a soft phase and a hard phase, the soft phase being a copolymer of aliphatic fluorine-free species and a fluorinated aliphatic species, and hard phase being formed from diisocyanate containing segments and an amine curative agent, wherein the polishing layer has a top surface having a groove pattern and the groove pattern comprises a plurality of first grooves having a first groove cross-section, the plurality of first grooves defining a plurality of regions between adjacent first grooves; and, in a portion of the plurality of region between adjacent first grooves, a plurality of second grooves having a second groove cross-section, wherein the second groove cross-section is less than 50 percent of the first groove cross-section, wherein the polishing layer is further characterized by having a specific gravity of at least 1.05 grams per cubic centimeter.

Also disclosed is a method of polishing a substrate comprising providing polishing pad having a top surface a top surface having a groove pattern that comprises a plurality of first grooves having a first groove cross-section, the plurality of grooves defining a plurality of regions between adjacent first grooves; and, in a portion of the plurality of region between adjacent first grooves, a plurality of second grooves having a second groove cross-section, wherein the second groove cross-section is less than 50 of the first groove cross-section, wherein the polishing layer is further characterized by having a specific gravity of at least 1.05 grams per cubic centimeter moving the top surface of the polishing pad against the substrate at a down force of less than 30 kilopascals (kPa) to remove material from the substrate.

BRIEF DESCRIPTION OF THE DRAWINGS

Referring now to the figures, which are exemplary embodiments, and wherein the like elements are numbered alike.

DETAILED DESCRIPTION OF THE INVENTION

The polishing pad as disclosed herein comprises a polishing layer comprising a fluorine containing polyurea having hard and soft phases. The polishing layer has a groove pattern on a top surface that provides good texture during use. The groove pattern has been surprisingly found to yield a better removal rate at low polishing down-forces than other pads, including polishing pads comprising other polymer materials, having lower specific gravity (having higher porosity), and having only a standard pad groove pattern, particularly when used in combination with the fluorine containing polyurea even for high specific gravity or non-porous polishing layers.

Groove Pattern

The polishing pad includes a plurality of first grooves having relatively large depth, relatively large width (and thus a large first groove cross-section) and relatively large pitch. For purposes of this specification, cross-section is the cross-sectional area of a groove. For orthogonal grooves, the cross-section is the width multiplied by the depth. For non-orthogonal cross-sections various geometric equations and measurements can be used to determine cross-section. The pitch of the first grooves can be, for example, from 2.5 to 15, or 3 to 10, times the width of the grooves. Interspersed between adjacent grooves of the plurality of first grooves are a plurality of second grooves having relatively small depth, relatively small width (and thus a small second groove cross-section) and relatively small pitch. The pitch of the second grooves can be, for example 1.5 to 10, or 2 to 8 times the width of the second grooves.

The second groove cross-section can be from 5%, or from 10% up to 50%, up or less than 40% of the first groove cross-section.

Figure 1:
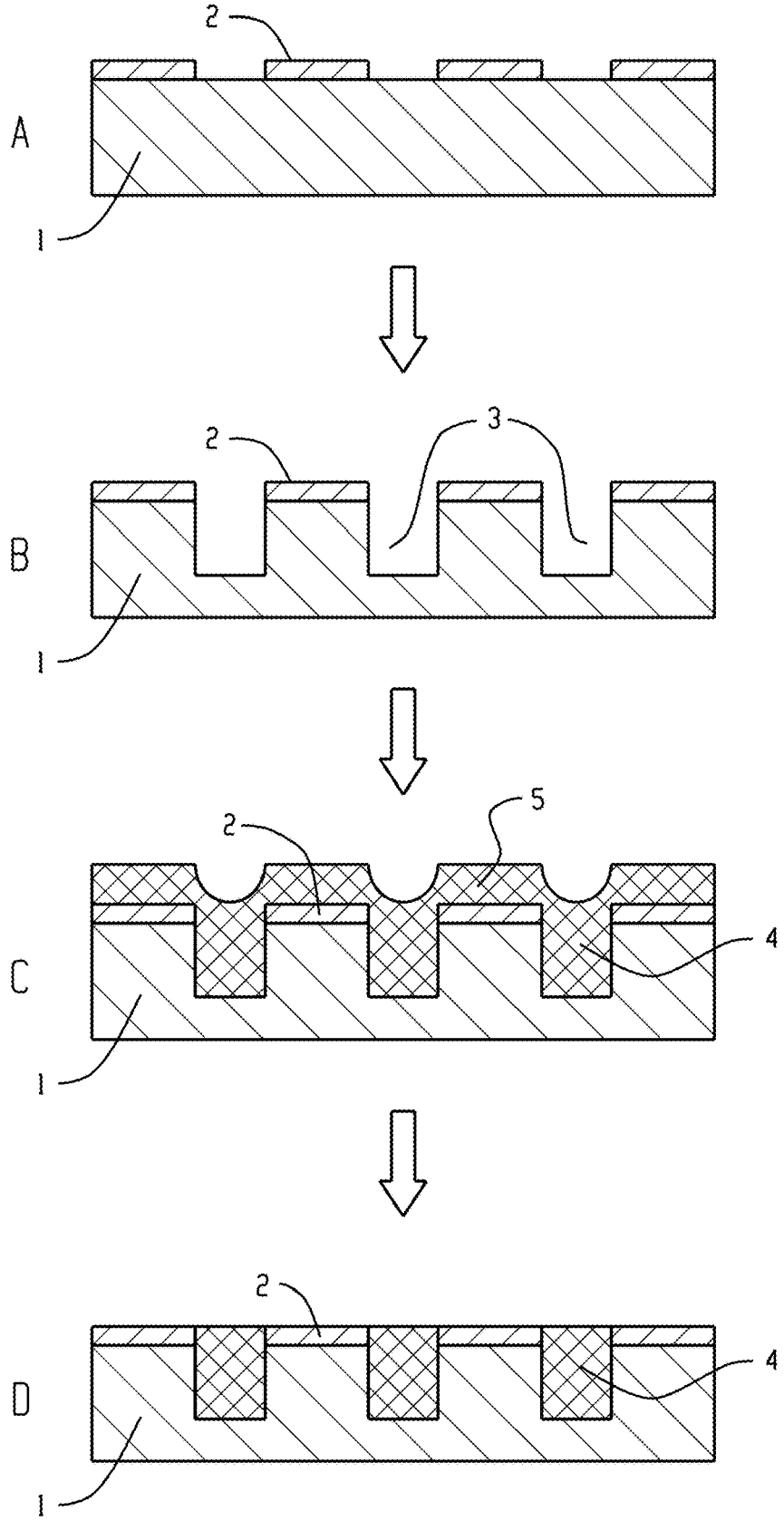
FIG. 1 is a schematic showing shallow trench isolation.
Figure 2:
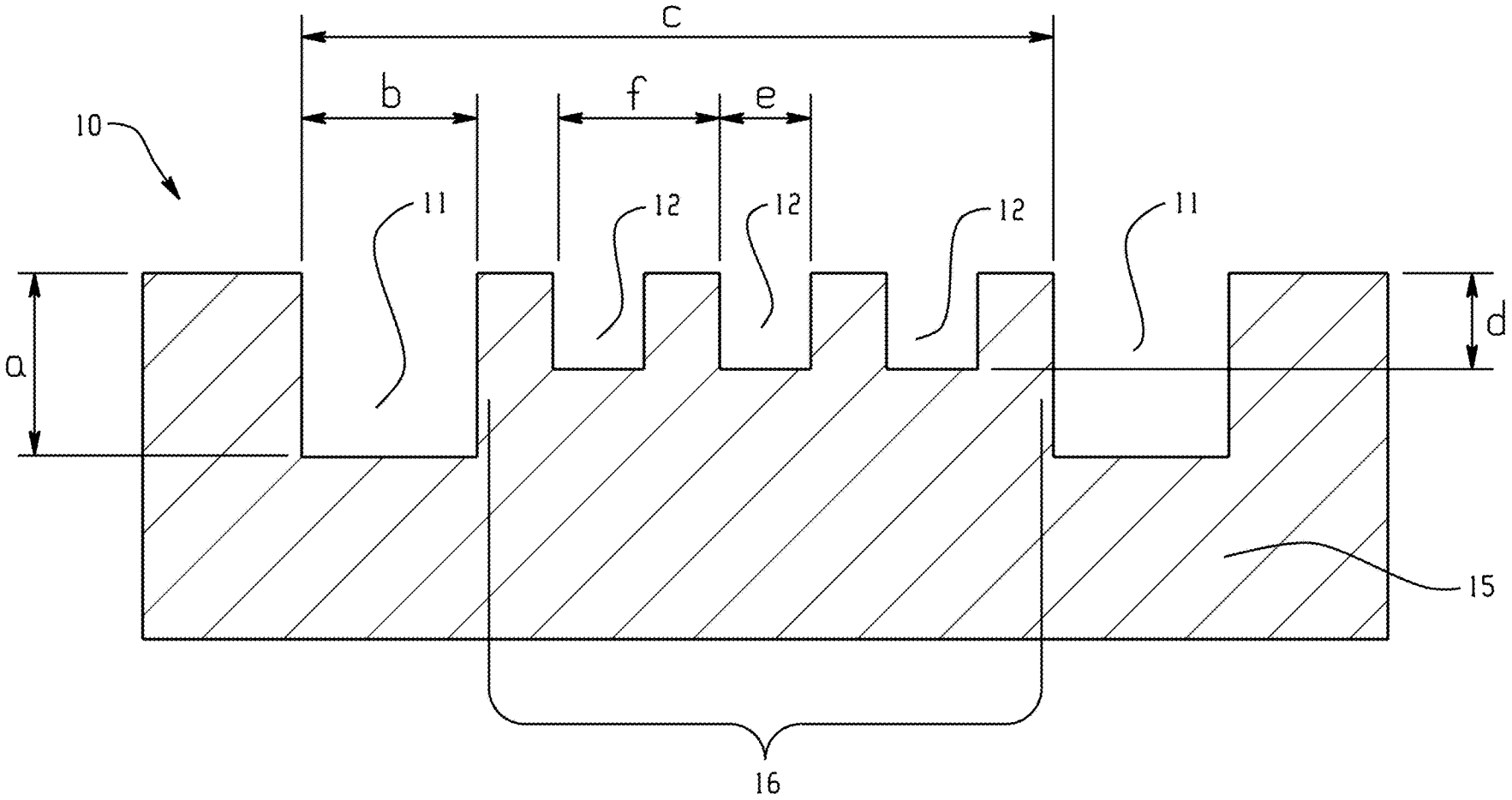
FIG. 2 is a cross section of a portion of an example of a pad as disclosed herein showing a portion of the groove pattern.

For example, FIG. 2 shows a cross-section of a portion of a pad 10 having a polishing layer 15 where one set of the smaller cross-section second grooves 12 are located in a region 16 between adjacent larger cross-section first grooves 11.

The first grooves 11 have first groove depth, a, a first groove width, b, and a first groove pitch, c. For a rectangular groove as shown, the groove depth, a, times the groove width, b, is the first groove cross-section. The second grooves 12 can have a second groove depth, d, a second groove width, e, and a second groove pitch, f. For a rectangular groove, the groove depth, d, times the groove width, e, is the second groove cross-section. For clarity "pitch" (e.g., c or f), is the distance from a first edge of a first groove across the opening of the groove and to a first edge of an adjacent groove for that set of grooves. While the grooves are shown with a rectangular cross section, curved or arced cross sections or trapezoidal cross sections can alternatively be used for either or both of the first grooves and the second grooves.

In regard to the first grooves 11, the first groove depth, a, can be up to 50% of the thickness of the polishing layer 15. Deeper grooves tend to reduce the overall pad stiffness to a point where the pad loses planarization ability. For example, the first groove depth, a, can be at least 0.5, at least 0.55, at least 0.6, at least 0.65 or at least 0.7 mm, while the first groove depth, a, can be up to 1.1, up to 1, up to 0.9, or up to 0.8 mm. The first groove width, b, can be at least 0.35, at least 0.4, at least 0.45, at least 0.47 or at least 0.5 mm. The first groove width, b, can be up to 0.8, up to 0.75, up to 0.7, up to 0.65, or up to 0.6 mm. The first groove pitch, c, can be at least 2, or at least 2.5 mm up to 5 or up to 4 mm.

For the second grooves 12, the second groove depth, d, can be from 30 to 70%, preferably 40-60% of the depth, a. Alternatively, or in addition, the second groove depth, d, can be at least 0.1, or at least 0.15, or at least 0.2 or at least 0.25 mm up to 0.5 or up to 0.45 mm. The second groove width, e, can be 30 to 70%, preferably 40-60% of the width, b. Alternatively, or in addition, the second groove width, e, can be at least 0.05, at least 0.1, or at least 0.12 mm up to 0.33, or up to 0.3, or up to 0.27 mm. The second groove pitch, f, can be 0.5 to 1 mm. There can be several (e.g., example, 3, 4 or 5), of the second grooves 12 in each region 16 in the pad 10.

Figure 3:
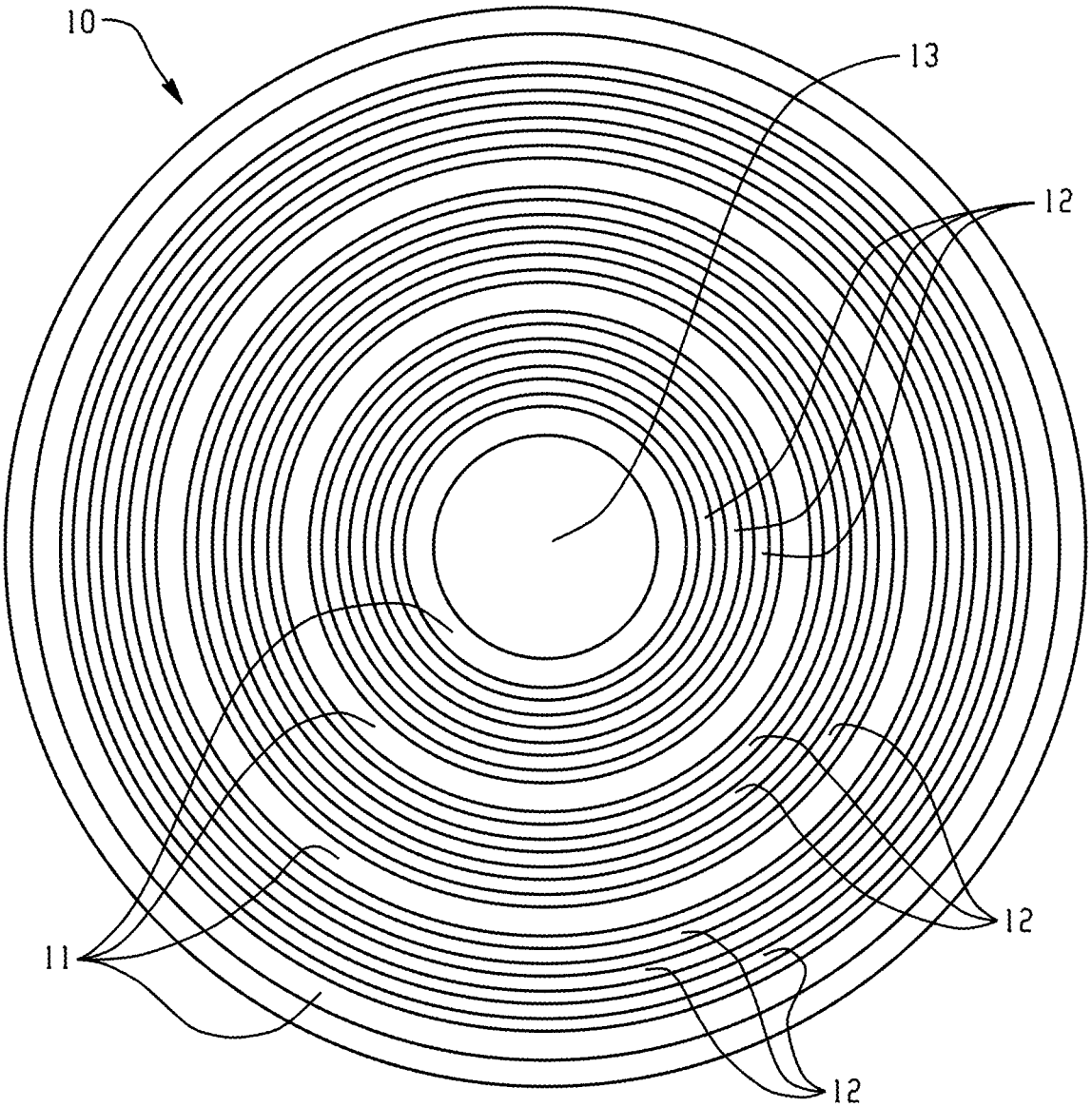
FIG. 3 is a top view of an example of a pad having a groove pattern as disclosed here (not to scale).

FIG. 3 shows a top view of a pad (not to scale) having the small second grooves 12 between the adjacent grooves of the large first grooves 11 arranged in concentric circles on the pad. A center un-grooved portion or center button 13 is shown. Other groove arrangements could be used in addition or instead of the concentric circles. For example, radial grooves extending from the center of the pad toward the outer edge of the pad can be used. For example, concentric grooves can be used in combination with radial grooves. For example, the large first grooves could include both concentric grooves and radial grooves with the small second grooves located in regions between the large first grooves. For example, the large grooves and the small grooves can be in concentric circles with radial grooves intersecting with both the large and small concentric grooves. Other layouts of grooves include polygons—e.g. octagonal grooves. The grooves can be arranged around the center point of the pad or an offset structure could be used.

The polishing layer can have an average thickness of from 0.8 mm up to 4 mm, from 1 mm up to 3 mm, or from 1.2 mm up to 2.5 mm.

Polishing Layer Composition

The polishing layer can comprise a fluorinated polyurea having hard and soft segments.

The hard phase comprises the rigid hard segments that provide stiffness. The hard phase can be amorphous or can be partially crystalline and partially amorphous. The amorphous portion has a relatively high glass transition temperature (Tg) as compared to the soft phase (soft segments). The Tg of the hard phase can be, for example, in the range of 100 to 170° C. The crystalline portions can have a melting temperature, Tm 200-270° C.

The soft phase comprises segments generally having a low Tg relative to the Tg of the hard phase segments and are more flexible at room temperature. Phase separation occurs due to immiscibility between the hard and soft segments. The Tg of the soft phase can be, for example, in the range of −40 to 130° C. Tg and Tm can be determined by dynamic mechanical spectroscopy.

The hard and soft segments can be covalently bonded using a curative agent, such as a polyamine (e.g., a diamine). The amine groups react with the isocyanate groups of the hard segment component (e.g., prepolymer) and the soft segment (e.g., prepolymer) forming the urea linkages of the polyurea.

The soft phase can be formed from a soft segment having one or more aliphatic fluorine-free species (e.g., monomer, dimer, trimer, or higher oligomer) and at least one fluorinated species (e.g., monomer, or a macromolecule such as an oligomer) each having two reactive end groups. The fluorinated species can have a length of at least six, at least 8, up to 20, or 16 carbon atoms. For example, the fluorinated species can include a macromolecule (e.g., oligomer) of a fluorinated alkylene oxide and a non-fluorinate alkylene oxide. The aliphatic fluorine-free polymer groups are bonded with the reactive end groups of the at least one fluorinated species. The linkage can be a nitrogen-containing linkage. Examples of nitrogen-containing linkages include urea and urethane groups. The aliphatic fluorine-free polymer groups have one end attached to the at least one fluorinated species nitrogen-containing linkage. An isocyanate group can cap the reaction ends of the aliphatic fluorine-free polymer groups. Typically, the aliphatic fluorine-free polymer species that are reacting can have a number average molecular weight 200 to 7500, or 250 to 5000 grams/mole, e.g. as measure by Gel Permeation Chromatography (GPC) or as specified on product literature. For purposes of clarity, the number average molecular weight of the aliphatic fluorine-free polymer groups end does not include any of the following: isocyanate end groups, nitrogen-containing linkages or the amine curative. The soft segment forms a soft phase within the polyurea matrix. The aliphatic fluorine-free polymer group can be a polytetramethylene ether that links with the fluorinated species. The fluorinated species can include at least one fluorinated ether. The fluorinated species can comprise the reaction product of fluorinated ethylene oxide, fluorinated oxymethylene and ethylene oxide. The atomic ratio of fluorinated ether groups such as fluorinated ethylene oxide and fluorinated oxymethylene to ethylene oxide can be less than 3.

The hard phase can be formed from a diisocyanate-containing hard segment that does not contain a fluorine group and the amine-containing curative agent. The hard segment contains a urea group formed from the isocyanate group capping outer ends of the aliphatic fluorine-free polymer groups reacted with an amine-containing curative agent. Preferably, the hard segments precipitate as a hard phase within the soft phase. This morphology provides a fluorine-rich phase for improving ceria interactions and a hard phase for strengthening the soft phase to improve polishing asperity integrity for enhanced pad life and stability while polishing multiple wafers. Preferably, the hard segment and soft segment form a prepolymer before reacting the prepolymer with the amine-containing curative agent to form the polyurea matrix. The presence of fluoride moieties in the soft segment increases the soft segment glass transition temperature or Tg of the soft phase. This unexpected increase in glass transition temperature improves thermal stability of the polymer. At the very upper surface of the polymer in air, enrichment of the fluorinated soft segment components occurs during polishing. This in situ and continuous generation of fluorine rich phase at the surface further enhances the beneficial impact of a minor amount of fluoropolymer. At relatively low fluorinated soft segment concentrations (for example, below 20 wt % of the total soft segment content), the amount of fluorinated species is insufficient to prevent water molecular dipole rearrangement when the polymer is subsequently exposed to water, especially under shear. This results in a complex wetting behavior when the droplet is exposed to shear. Specifically, the water surface is believed to rearrange giving rise to increased water interaction with the hydrophilic portions of the polymer. This results in a reduction in the receding contact angle of the droplet and a corresponding increase in the surface energy during polishing. The result is that, under shear, the polishing pad of the invention can be even more hydrophilic than its fluorine-free analog.

The polyurea used in the polishing layer of the polishing pads disclosed herein are block copolymers. An isocyanate terminated urethane prepolymer that can be used in the formation of the polishing layer of the chemical mechanical polishing pad disclosed herein can comprise: a reaction product of ingredients, comprising: a polyfunctional isocyanate and a prepolymer mixture containing two or more components, one of that is fluorinated.

The isocyanate is polyfunctional, for example, a diisocyanate. Examples of diisocyanates include 2,4-toluene diisocyanate; 2,6-toluene diisocyanate; 4,4' diphenylmethane diisocyanate; naphthalene-1,5-diisocyanate; toluidine diisocyanate; para-phenylene diisocyanate; xylylene diisocyanate; isophorone diisocyanate; hexamethylene diisocyanate; 4,4'-dicyclohexylmethane diisocyanate; cyclohexanediisocyanate; and mixtures thereof. The diisocyanate can be toluene diisocyanate.

The aliphatic fluorine-free polymer groups can be reacted from the group consisting of diols, polyols, polyol diols, copolymers thereof, and mixtures thereof. For example, it is possible to react the aliphatic fluorine-free polymer groups with a diisocyanate and then link the fluorinated species to the diisocyanate. A prepolymer polyol can be selected from the group consisting of polyether polyols (e.g., polyakylene glycols where the alkylene comprises 2 to 5 carbon atoms, such as poly(oxytetramethylene) glycol, poly(oxypropylene) glycol, polyoxyethylene) glycol); polycarbonate polyols; polyester polyols; polycaprolactone polyols; mixtures thereof; mixtures of one or more thereof with one or more low molecular weight polyols selected from the group consisting of ethylene glycol; 1,2-propylene glycol; 1,3-propylene glycol; 1,2-butanediol; 1,3-butanediol; 2-methyl 1,3-propanediol; 1,4-butanediol; neopentyl glycol; 1,5-pentanediol; 3-methyl-1,5-pentanediol; 1,6-hexanediol; diethylene glycol; dipropylene glycol; and, tripropylene glycol. The prepolymer polyol can be polytetramethylene ether glycol (PTMEG); polypropylene ether glycols (PPG), polyethylene ether glycols (PEG); or mixtures thereof optionally, mixed with one or more low molecular weight polyol selected such as ethylene glycol; 1,2-propylene glycol; 1,3-propylene glycol; 1,2-butanediol; 1,3-butanediol; 2-methyl-1,3-propanediol; 1,4-butanediol; neopentyl glycol; 1,5-pentanediol; 3-methyl-1,5-pentanediol; 1,6-hexanediol; diethylene glycol; dipropylene glycol; and tripropylene glycol. The prepolymer polyol can be primarily (e.g., ≥ 90 wt %) polytetramethylene ether. The fluorinated polyol can be made from any of the unfluorinated polyols cited above, with fluorine added via replacement. This creates minimal variation in the final mechanical properties.

The isocyanate terminated urethane prepolymer can have an unreacted isocyanate (NCO) concentration of 8.5 to 9.5 wt %. Examples of commercially available isocyanate terminated urethane prepolymers include Imuthane™ prepolymers (available from COIM USA, Inc., such as, PET-80A, PET-85A, PET-90A, PET-93A, PET-95A, PET-60D, PET-70D, PET-75D); Adiprene™ prepolymers (available from Chemtura, such as, LF-800A, LF-900A, LF-910A, LF-930A, LF-931A, LF-939A, LF-950A, LF-952A, LF-600D, LF-601D, LF-650D, LF-667, LF-700D, LF-750D, LF-751D, LF-752D, LF-753D and L325); Andur™ prepolymers (available from Anderson Development Company, such as, 70APLF, 80APLF, 85APLF, 90APLF, 95APLF, 60DPLF, 70APLF, 75APLF).

The isocyanate terminated urethane prepolymer can be a low free isocyanate terminated urethane prepolymer having less than 0.1 wt % free toluene diisocyanate (TDI) monomer content.

The curative can be, for example, such as a polyfunctional amine or a polyfunctional alcohol. The polyfunctional amine curative can be a polyfunctional aromatic amine. Specific examples of such amines include as bis(4-amino-2-chloro-3,5-diethylphenyl)methane ("MCDEA"), diethyltoluenediamine (DETDA); 3,5-dimethylthio-2,4-toluenediamine and isomers thereof; 3,5-diethyltoluene-2,4-diamine and isomers thereof (e.g., 3,5-diethyltoluene-2,6-diamine); 4,4'-bis-(sec-butylamino) diphenylmethane; 1,4-bis-(sec-butylamino)-benzene, 4,4'-methylene-bis-(2-chloroaniline) polytetramethyleneoxide-di-p-aminobenzoate; N,N-dialkyl diamino diphenyl methane; p,p'-methylene dianiline (MDA); m-phenylenediamine (MPDA); 4,4'-methylene-bis (2-chloroaniline) (MBOCA); 4,4'-methylene-bis-(2,6-diethylaniline) (MDEA); 4,4'-methylene-bis-(2,3-dichloroaniline) (MDCA); 4,4'-diamino-3,3'-diethyl-5,5'-dimethyl diphenylmethane, 2,2',3,3-tetrachloro diamino diphenyl methane; trimethylene glycol di-p-aminobenzoate; and mixtures thereof.

The polishing layer can have a high specific gravity indicating low porosity or no porosity. For example, the polishing layer can have a specific gravity of greater than 1.05, greater than 1.10, greater than 1.12, greater than 1.15, greater than 1.16, or greater than 1.17 grams/cubic centimeter as measured according to ASTM D1622 (2014). The polishing layer can comprise a low amount of a porogen (e.g., a porous microsphere) or no porogen such that the volume % porosity can be 0 to 5, 0 to 2, 0 to 1, 0 to 0.5, 0 to 0.1, or zero. The volume % of porosity can be determined by dividing the difference between the specific gravity of an unfilled polishing layer and specific gravity of the polishing layer comprising porogen by the specific gravity of the unfilled polishing layer. The polishing layer can be free of pores. The polishing layer can be free of porogens.

The polishing layer can include solid, non-porous filler, such as polymeric particles, lubricating particles, abrasive particles or the like. If included the amount of such solid, non-porous filler is included in amounts of 0 to 30, 0 to 20, 0 to 15, or 0.1 to 15% by weight based on total weight of the polishing layer. The polishing layer can be free of filler.

Manufacture and Use of the Polishing Pad

The polishing layer disclosed herein can be made by methods comprising: providing the isocyanate terminated urethane prepolymer; providing separately the curative component; and combining the isocyanate terminated urethane prepolymer and the curative component to form a combination; allowing the combination to react to form a product; forming a polishing layer from the product, such as by skiving (i.e. slicing) the product to form a polishing layer of a desired thickness. Alternatively, they may be made in a more precise net shape form. For example, the following process can be used: 1. thermoset injection molding (often referred to as "reaction injection molding" or "RIM'); 2. thermoplastic or thermoset injection blow molding; 3. compression molding; or 4. any similar-type process in which a flowable material is positioned and solidified, thereby creating at least a portion of a pad's macrotexture or microtexture. In a molding example: 1. the flowable material is forced into or onto a structure or substrate; 2. the structure or substrate imparts a surface texture into the material as it solidifies; and 3. the structure or substrate is thereafter separated from the solidified material. After forming the polishing layer the grooving can be added by machining. Alternatively, some grooving could be provided by forming individual layers in a mold with a groove pattern.

The polishing pad disclosed herein optionally further comprises at least one additional layer interfaced with the polishing layer. For example, the CMP polishing pad optionally can further comprise a compressible base layer (also referred to as a sub-pad) adhered to the polishing layer. The compressible base layer can improve conformance of the polishing layer to the surface of the substrate being polished.

The polishing pad disclosed herein can be adapted to be interfaced with a platen of a polishing machine. For example, the CMP polishing pad can be adapted to be affixed (e.g., using at least one of a pressure sensitive adhesive or vacuum) to the platen of a polishing machine.

CMP polishing pads can be, and preferably is, used in conjunction with a polishing slurry, as described in the Background herein. Particularly, the polishing pads having the groove pattern as disclosed herein can be used in a method as follows: providing a substrate to be polished, providing a polishing pad having a top surface having a groove pattern as described herein, polishing the substrate by moving the top surface of the polishing pad against the substrate to remove material from the substrate. Particularly, the polishing movement can be at a low down force such as less than 30 kilopascals (kPa), preferably less than 28 kPa, more preferably less than 25 kPA. The down force can be at least 15, or at least 20 kPA. Surprisingly, this method with such a pad can achieve a removal rate substantially higher than for a pad of the same composition but lacking the recited groove pattern. For example, the method of polishing a substrate at a downforce of 20 kPa can yield a removal rate at least 30% (preferably at least 40%, more preferably at least 50%, still more preferably at least 60%, even more preferably at least 70%, and most preferably greater than 75%) higher than achieved under the same polishing conditions for a pad having the same specific gravity and composition but without the disclosed groove pattern (where the percent is based on the removal rate of the similar pad). This relative increase in removal rate at low downforces is particularly attained for substantially non-porous pads having specific gravities of more than 1.05, more than 1.1, or more than 1.15 g/cubic centimeter.

Thus, this method is particularly suited for shallow trench isolation where the substrate comprises a wafer having trenches filled with a material with an overburden.

EXAMPLES

Materials

The PTMEG was a blend of various PTMEGs.

4,4'-Dicyclohexylmethane diisocyanate (H12MDI)

Toluene diisocyanate (TDI).

Toluene diisocyanate ("H12MDI/TDI") PTMEG was a prepolymer having an NCO of 8.95 to 9.25 wt %.

The polymeric microspheres were vinylidene chloride-polyacrylonitrile copolymer microspheres, having an average particle diameter of about 20 μm.

The fluoropolymer was an ethoxylated perfluoroether. The fluoropolymer had a linear structure of fluorinated ethylene oxide-fluorinated oxymethylene capped with ethylene oxide. The atomic ratio "R" of fluorinated ether to ethylene oxide was either 1.9 or 5.3.

MCDEA was
Bis(4-amino-2-chloro-3,5-diethylphenyl)methane

Process for Making Pads with Fluorinated Polyurea Copolymer

Fluorinated prepolymers were synthesized in batches ranging from approximately 200 to 1000 gram. The ethoxylated perfluoroether and PTMEG were mixed to yield the desired level of fluorination of polytetramethyl ether. TDI and H12MDI were mixed at 80:20 weight ratio before adding to the mixture. Enough isocyanate mixture was then added to the mixture of ethoxylated perfluoroether and PTMEG to achieve the desired NCO wt %. The whole mixture was again mixed and then placed in a pre-heated oven at 65° C. for 4 hours before use.

The prepolymers were heated to 65° C. A cure agent (a 50/50 weight mixture of MBOCA and MCDEA) was preweighted and melted in oven at 110° C. Where used, polymeric microspheres were added to the prepolymers after the 4 hour reaction time or once heated and degassed with polymeric microspheres in prepolymer via vacuum. All filled samples include a distribution of polymeric microspheres sufficient to reach either a specific gravity or final density. After degassing and once both components are at temperature, the cure agent was added to the prepolymer and mixed. After mixing, the sample was poured onto a heated plate and drawn using a Teflon™ fluoropolymer-coated bar with a spacer set at 175 mil (4.4 mm). The plate was then transferred into an oven and heated to 104° C. and held at temperature for 16 hours. The drawdown is then demolded and punched down to 22 inches (55.9 cm) and used to prepare a laminated pad for polishing. All pads were 30" (76 cm) in diameter with an 80 mil (2.0 mm) top pad, pressure sensitive adhesive film for the sub pad, Suba IV™ polyurethane impregnated polyester felt sub pad, and pressure sensitive platen adhesive.

Example 1

Pads were prepared having the polishing layer polymer material, specific gravity, polymeric microsphere, and second groove pattern as shown in Table 1. Each pad had a first groove pattern having a circular concentric grooves having width of 20 mils (0.508 mm), a depth of 30 mils (0.762 mm), and a pitch of 120 mils (3.048 mm) and radial grooves having the same width and depth as the circular concentric grooves. Certain pads had a second groove pattern of a three grooves between each pair of first concentric grooves. These second grooves had a width of 10 mils (0.254 mm), a depth of 15 mils (0.381 mm), and a pitch of 30 mils (0.762 mm).

TABLE 1

| Pad ID | Polymer | Specific Gravity (g/cubic centimeter) | Polymeric microspheres (wt % based on total weight of polishing layer material) | Second grooves |
|---|---|---|---|---|
| A | Non-fluorinated polyurethane* | 1.18 | None | None |
| B | Non-fluorinated polyurethane* | 1.18 | None | Yes |
| C | Fluorinated polyurea copolymer | 1.18 | None | None |
| D | Fluorinated polyurea copolymer | 0.95 | 1.61 wt % | None |
| E | Fluorinated polyurea copolymer | 0.95 | 1.61 wt % | Yes |
| 1 | Fluorinated polyurea copolymer | 1.18 | None | Yes |

*This non-fluorinated polyurethane was from a PTMEG prepolymer with isocyanate in amounts of NCO of 9.15 wt % reacted with MBOCA 105% at an amine to NCO mole ratio of 105% based on moles of NCO.

Example 2

Figure 4:
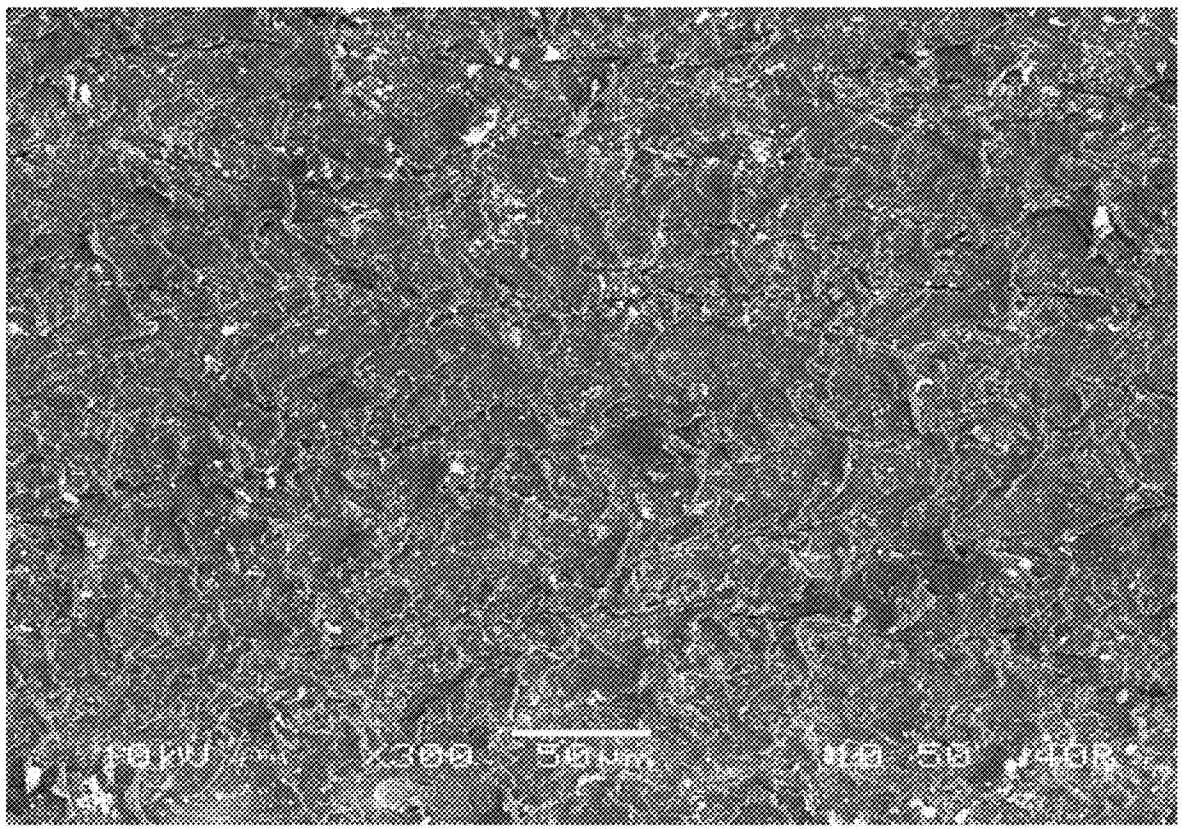
FIG. 4 is a scanning electron micrograph (SEM) of in the pad as in Sample 1 of the invention after polishing.
Figure 5:
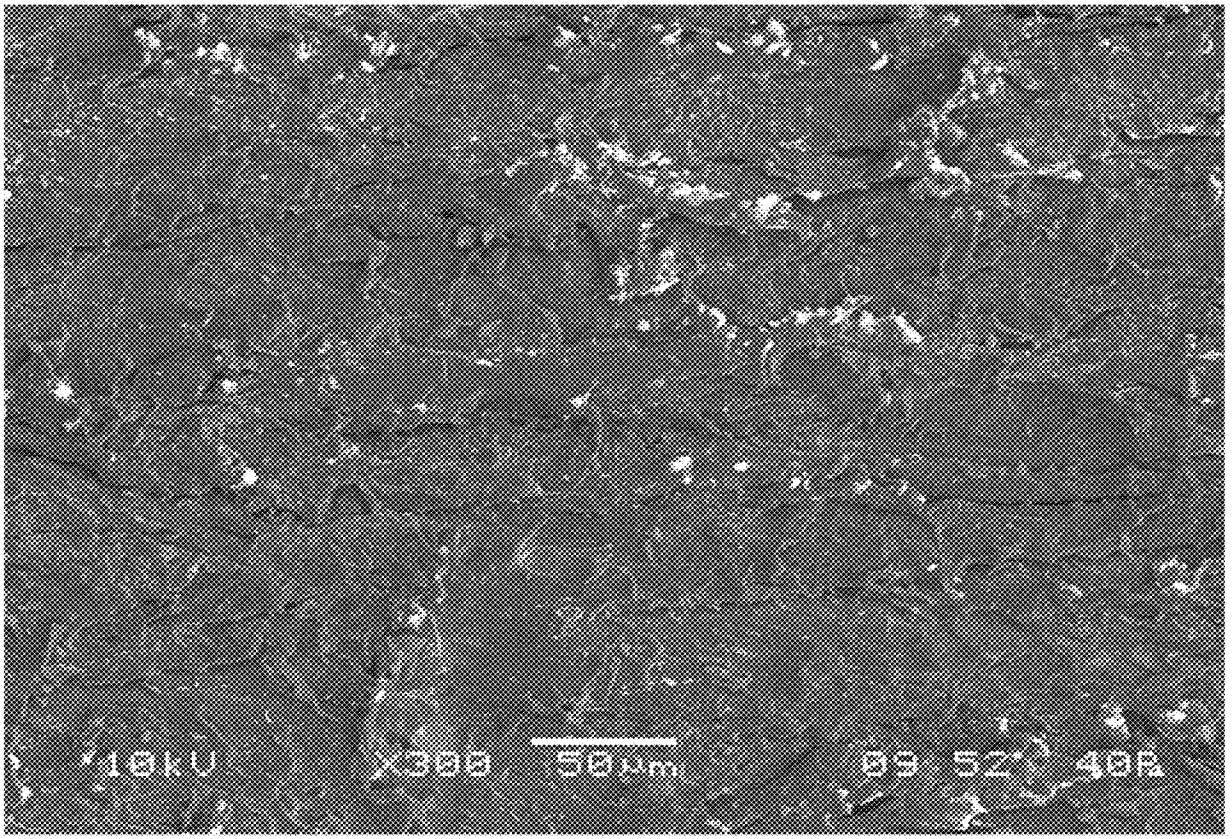
FIG. 5 is a scanning electron micrograph (SEM) of a pad as in Sample C after polishing.
Figure 6:
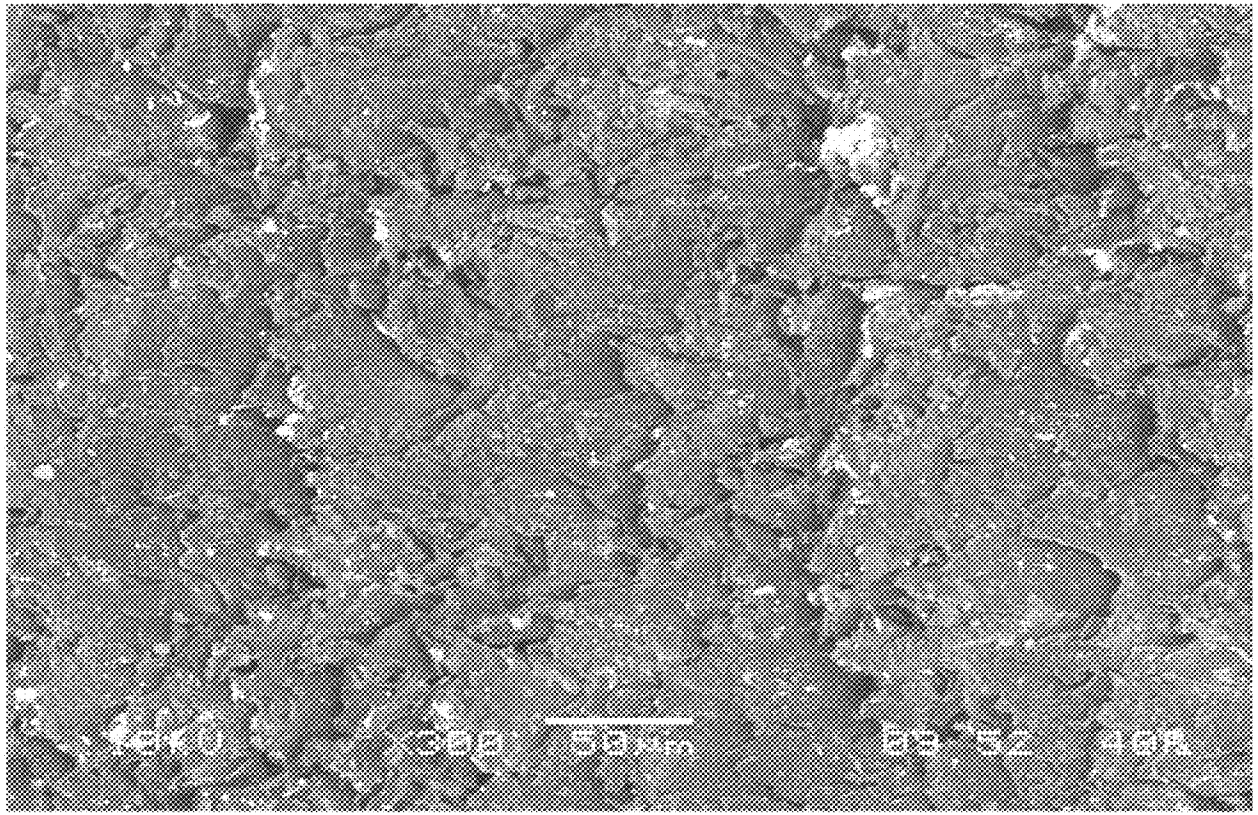
FIG. 6 is a scanning electron micrograph (SEM) of a pad as in Sample D after polishing.
Figure 7:
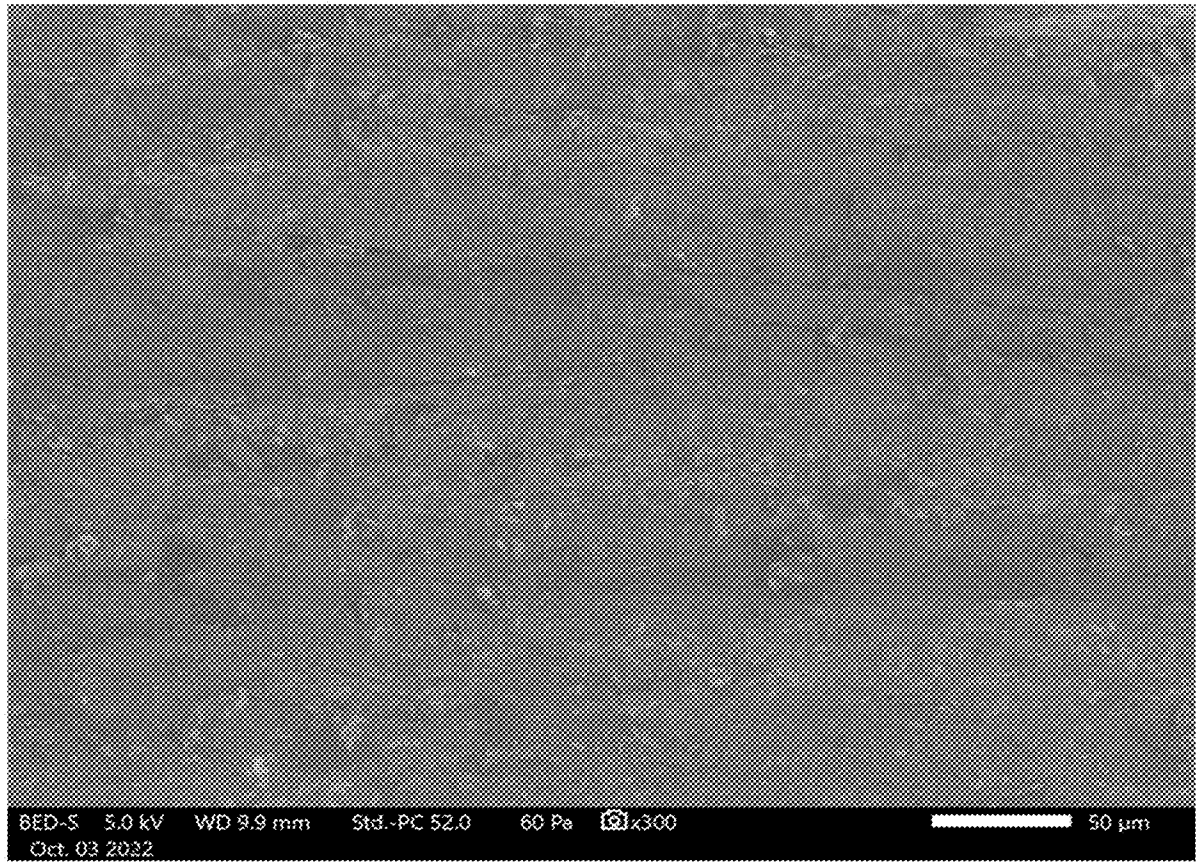
FIG. 7 is a scanning electron micrograph (SEM) of a pad as in Sample B after polishing.

Scanning electron micrographs of pads B, C, D, and after polishing revealed different textures provided by the materials of the pad and the grooving. FIG. 7, the SEM of pad B, showed a substantially flat texture when the non-fluorinated polymer was used even when the groove pattern as disclosed herein was used. In contrast, FIG. 4, the SEM of Sample 1 showed substantial denticle texture in an unfilled pad of a fluorinated copolymer with the grooves as disclosed herein. FIG. 5 that is an SEM of Sample C, an unfilled pad of the fluorinated copolymer but which lacked the second grooves, shows some texture but more flat regions that were seen in FIG. 4. FIG. 6, the SEM of Sample D had a low specific gravity (i.e. porosity) shows texture but less uniform than for Sample 1.

Example 3

The pads were used with a standard ceria slurry to polish a substrate comprising silicon oxide at downforces of 3, 4 and 5 psi. The results are shown in Table 2. Sample 1 showed remarkably better removal rate in Angstroms per minute at 3 psi (20 kPa) and a better removal rate at 4 psi than the other samples. Table 2 also shows that comparing pads that have the same composition and specific gravity adding the small second grooves significantly improved removal rate at the low down-forces.

TABLE 2

| Sample | RR @ 3 psi (20 kPa) | RR @ 4 psi (28 kPa) | RR @ 5 psi (34 kPa) |
|---|---|---|---|
| A | 3836 | 4482 | 5487 |
| B | 6456 | 7683 | 8864 |
| C | 4673 | 6306 | 8317 |
| D | 4993 | 9173 | 11146 |
| E | 6535 | 9127 | 11687 |
| Sample 1 | 8463 | 9624 | 10432 |

This disclosure further encompasses the following aspects.

Aspect 1: A polishing pad suitable for chemical mechanical polishing comprising: a polishing layer including a polyurea having a soft phase and a hard phase, the soft phase being a copolymer of aliphatic fluorine-free species and a fluorinated aliphatic species, and hard phase being formed from diisocyanate containing segments and an amine curative agent, wherein the polishing layer has a top surface having a groove pattern, the groove pattern comprises a plurality of first grooves having a first groove cross-section, the plurality of first grooves defining a plurality of regions between adjacent first grooves; and, in a portion of the plurality of region between adjacent first grooves, a plurality of second grooves having a second groove cross-section, wherein the second groove cross-section is less than 50, preferably less than 40 percent, preferably at least 10 percent, preferably at least 20 percent of the first groove cross-section, wherein the polishing layer is further characterized by having a specific gravity of at least 1.05 grams per cubic centimeter.

Aspect 2: The polishing pad of Aspect 1 wherein the first grooves have a first width and a first pitch and the first pitch is from 2.5 to 15 times the first width (with width and pitch measured at the top of the groove).

Aspect 3: The polishing pad of Aspect 1 or 2 wherein the second grooves have a second width and a second pitch and the second pitch is 1.5 to 10 times the second width (with width and pitch measured at the top of the groove).

Aspect 4: A polishing pad suitable for chemical mechanical polishing comprising a polishing layer including a polyurea having a soft phase and a hard phase, the soft phase being a copolymer of aliphatic fluorine-free species and a fluorinated aliphatic species, and hard phase being formed from diisocyanate containing segments and an amine curative agent, wherein the polishing layer has a specific gravity of at least 1.05 grams per cubic centimeter and a top surface having a groove pattern that comprises a plurality of first grooves having a first groove width of greater than 0.35 up to 0.8 mm, (preferably from 0.4 up to 0.75 mm, more preferably from 0.45 up to 0.7 mm, yet more preferably from 0.47 up to 0.65 mm, and most preferably from 0.5 up to 0.6 mm), a first groove depth of from 0.5 up to 1.1 mm, (preferably from 0.6 up to 1 mm, more preferably from 0.6 up to 0.9 mm, and most preferably 0.7 to 0.8 mm), and a first groove pitch of from 2 up to 5 mm (preferably from 2.5 up to 4 mm), the plurality of first grooves defining a plurality of regions between adjacent first grooves; and, in a portion of the plurality of regions between adjacent first grooves, a plurality of second grooves having a second groove width, a second groove depth and a second groove pitch characterized by one or both of (a) the second groove width is 30-70% (preferably 40-60%) of the first groove width, the second groove depth is 30-70% (preferably 40-60%) of the first groove depth, and the second groove pitch is 15-40% of the first groove pitch and (b) the second groove width is from 0.05 up to 0.33 mm (preferably from 0.1 up to 0.3 mm, more preferably 0.12 up to 0.27 mm), the second groove depth is from 0.1 up to 0.5 mm (preferably 0.25 to 0.45 mm) and the second groove pitch is from 0.5 to 1 mm.

Aspect 5. The polishing pad of any one of the previous Aspects wherein the specific gravity is 1.1 or more.

Aspect 6. The polishing pad of any one of the previous Aspects that is non-porous.

Aspect 7. The polishing pad of any one of any one of the previous Aspects wherein the plurality of the second grooves in the region between adjacent first grooves comprises two, or at least two, three, or at least three, four, or at least four, five, or at least 5 of the second grooves.

Aspect 8. The polishing pad of any one of the previous Aspects wherein each of the plurality of regions between adjacent first grooves comprises the plurality of the second grooves.

Aspect 9. The polishing pad of any one of the previous Aspects wherein the polishing layer further comprises a non-porous filler, preferably in amounts less than 30 weight percent, more preferably less than 20 weight percent, still more preferably less than 15 weight percent.

Aspect 10. The polishing pad of any one of the previous Aspects wherein at least of portion (or all) of the plurality of first grooves are arranged concentrically around the center of the pad.

Aspect 11. The polishing pad of any one of the previous Aspects wherein at least of portion of the plurality of first grooves extend radially from the center of the pad.

Aspect 12. The polishing pad of Aspect 10 wherein at least a portion of the plurality of second grooves are arranged concentrically around the center of the pad.

Aspect 13. The polishing pad of Aspect 12 wherein at least of portion of the plurality of first grooves extend radially from the center of the pad and the plurality of second grooves intersect with the portion of the plurality of first grooves extending radially from the center of the pad.

Aspect 14. A method of polishing a substrate comprising providing polishing pad having a top surface a top surface having a groove pattern that comprises a plurality of first grooves having a first groove cross-section, the plurality of first grooves defining a plurality of regions between adjacent first grooves; and, in a portion of the plurality of region between adjacent first grooves, a plurality of second grooves having a second groove cross-section, wherein the second groove cross-section is less than 50, preferably less than 40 percent of the width, preferably at least 10 percent, preferably at least 20 percent of the first groove cross-section, wherein the polishing layer is further characterized by having a specific gravity of at least 1.05 grams per cubic centimeter and moving the top surface of the polishing pad against the substrate at a down force of less than 30 kilopascals (kPa), preferably less than 28 kPa, more preferably less than 25 kPA, to remove material from the substrate.

Aspect 15. The method of Aspect 14 wherein the polishing pad is the polishing pad of any one of Aspects 1 to 13.

Aspect 16. The method of Aspect 14 or 15 wherein the down force is at least 15 kPA.

Aspect 17. The method of any one of Aspects 14-16 having a removal rate of the material from the substrate at 20 kPa downforce of at least 30% (preferably at least 40%, more preferably at least 50%, yet more preferably at least 60%, still more preferably at least 70%, and most preferably greater than 75%) higher than achieved under the same polishing conditions for a pad having the same specific gravity and composition but without the groove pattern of the polishing pad of Aspect 1 (where the percent is based on the removal rate of the similar pad).

Aspect 18. The method of any one of Aspects 14-17 wherein the substrate comprises a wafer having trenches filled with a material with an overburden.

Aspect 19. The method of any one of Aspects 14-18 comprising providing a polishing slurry between the top surface of the polishing pad and the substrate.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). Moreover, stated upper and lower limits can be combined to form ranges (e.g. "at least 1 or at least 2 weight percent" and "up to 10 or 5 weight percent" can be combined as the ranges "1 to 10 weight percent", or "1 to 5 weight percent" or "2 to 10 weight percent" or "2 to 5 weight percent").

The disclosure may alternately comprise, consist of, or consist essentially of, any appropriate components herein disclosed. The disclosure may additionally, or alternatively, be formulated so as to be devoid, or substantially free, of any components, materials, ingredients, adjuvants or species used in the prior art compositions or that are otherwise not necessary to the achievement of the function and/or objectives of the present disclosure.

Unless specified to the contrary herein, all test standards are the most recent standard in effect as of the filing date of this application, or, if priority is claimed, the filing date of the earliest priority application in which the test standard appears.

What is claimed is:

1. A polishing pad suitable for chemical mechanical polishing comprising:

a polishing layer including a polyurea having a soft phase and a hard phase, the soft phase being a copolymer of aliphatic fluorine-free species and a fluorinated aliphatic species, and hard phase being formed from diisocyanate containing segments and an amine curative agent, wherein the polishing layer has a top surface having a groove pattern, the groove pattern comprises a plurality of first grooves having a first groove cross-section, the plurality of first grooves defining a plurality of regions between adjacent first grooves; and, in a portion of the plurality of region between adjacent first grooves, a plurality of second grooves having a second groove cross-section, wherein the second groove cross-section is less than 50 percent of the first groove cross-section, wherein the polishing layer is further characterized by having a specific gravity of at least 1.05 grams per cubic centimeter.

2. The polishing pad of claim 1 having a specific gravity of 1.1 grams per cubic centimeter or more.

3. The polishing pad of claim 1 that is non-porous.

4. The polishing pad of claim 1 wherein a pitch of the first grooves is from 2.5 to 15 times a width of the first grooves and a pitch of the second grooves is from 1.5 to 10 times the width of the second grooves.

5. The polishing pad of claim 1 wherein each of the plurality of regions between adjacent first grooves comprises the plurality of the second grooves.

6. The polishing pad of claim 1 wherein the plurality of the second grooves in the region between adjacent first grooves comprises at least three of the second grooves.

7. The polishing pad of claim 1 wherein the polishing layer is hydrophilic during polishing in shear conditions.

* * * * *